US012612709B2

(12) United States Patent
Hickey et al.

(10) Patent No.: US 12,612,709 B2
(45) Date of Patent: Apr. 28, 2026

(54) METHOD OF INHIBITING TARNISH FORMATION AND CORROSION

(71) Applicant: Rohm and Haas Electronic Materials LLC, Marlborough, MA (US)

(72) Inventors: Anne Hickey, Cambridge, MA (US); Kristen M. Griffin, Boylston, MA (US)

(73) Assignee: DuPont Electronic Materials International, LLC, Marlborough, MA (US)

( * ) Notice: Subject to any disclaimer, the term of this patent is extended or adjusted under 35 U.S.C. 154(b) by 0 days.

(21) Appl. No.: 18/159,343

(22) Filed: Jan. 25, 2023

(65) Prior Publication Data

US 2023/0304181 A1 Sep. 28, 2023

Related U.S. Application Data

(62) Division of application No. 17/703,774, filed on Mar. 24, 2022.

(51) Int. Cl.
*C25D 3/54* (2006.01)
*C23F 15/00* (2006.01)
*C25D 5/00* (2006.01)

(52) U.S. Cl.
CPC ..... *C25D 3/54* (2013.01); *C23F 15/00* (2013.01)

(58) Field of Classification Search
CPC ..... C25D 3/54; C25D 5/00
USPC ..... 205/261
See application file for complete search history.

(56) References Cited

U.S. PATENT DOCUMENTS

| | | | | |
|---|---|---|---|---|
| 1,779,809 | A | 10/1930 | Gray | |
| 5,039,576 | A | 8/1991 | Wilson | |
| 6,852,427 | B1 | 2/2005 | Howell et al. | |
| 7,368,046 | B2 | 5/2008 | Adam et al. | |
| 8,491,774 | B2 | 7/2013 | Egli | |
| 9,145,616 | B2 | 9/2015 | Foyet et al. | |
| 9,850,588 | B2 | 12/2017 | Foyet et al. | |
| 10,056,707 | B2 | 8/2018 | Anderson et al. | |
| 11,255,811 | B2 | 2/2022 | Liu et al. | |
| 2002/0185716 | A1 | 12/2002 | Abys et al. | |
| 2004/0179309 | A1* | 9/2004 | Lee | H01F 41/18 257/295 |
| 2005/0121331 | A1 | 6/2005 | Kinoshita | |

(Continued)

FOREIGN PATENT DOCUMENTS

| | | | |
|---|---|---|---|
| DE | 102007028 211 | A1 | 12/2008 |
| EP | 0255558 | B1 | 11/1991 |

(Continued)

OTHER PUBLICATIONS

Cereceda-Company et al., "Electrochemical Growth of Bismuth for X-ray Absorbers," Journal of The Electrochemical Society (Jan. 1, 2018), vol. 165, No. 5, pp. D167-D182. (Year: 2018).*

(Continued)

*Primary Examiner* — Edna Wong
(74) *Attorney, Agent, or Firm* — Jonathan D. Baskin

(57) ABSTRACT

A method of inhibiting tarnish formation of silver or silver alloy and corrosion of gold or gold alloy by applying a thin coating of bismuth on the silver, silver alloy, gold or gold alloy. The thin bismuth coating does not compromise the electrical performance of the silver, silver alloy, gold or gold alloy even after thermal aging.

9 Claims, 3 Drawing Sheets

(56) References Cited

U.S. PATENT DOCUMENTS

| | | | | |
|---|---|---|---|---|
| 2012/0214293 | A1* | 8/2012 | Aksu | C25D 7/126 205/239 |
| 2012/0282481 | A1* | 11/2012 | Yasui | F16C 33/121 428/323 |
| 2017/0067174 | A1* | 3/2017 | Foyet | C25D 7/10 |
| 2017/0253983 | A1 | 9/2017 | Cahalen et al. | |
| 2022/0112619 | A1 | 4/2022 | Rodriquez | |

FOREIGN PATENT DOCUMENTS

| | | | | |
|---|---|---|---|---|
| EP | 2196563 | B1 | 6/2010 | |
| JP | 2003332391 | A1 | 11/2003 | |
| JP | 2006183079 | A1 | 7/2006 | |
| WO | WO-0037715 | A1 * | 6/2000 | C25D 3/54 |
| WO | 2012108378 | | 8/2012 | |
| WO | 2013142765 | A1 | 9/2013 | |
| WO | 2016056656 | A1 | 4/2016 | |
| WO | WO-2018200731 | A1 * | 11/2018 | G01N 27/26 |

OTHER PUBLICATIONS

Shen et al., "Silver-Bismuth Bilayer Anode for Perovskite Nanocrystal Light-Emitting Devices," The Journal of Physical Chemistry Letters (Apr. 28, 2020), vol. 11, No. 10, pp. 3853-3859. (Year: 2020).*

Moral-Vico et al., "Microstructure and Electrical Transport in Electrodeposited Bi Films," Journal of Electroanalytical Chemistry (Jan. 1, 2019), vol. 832, pp. 40-47. (Year: 2019).*

Khan, "Quantitative Estimation of Bismuth (Bi) Plated Felts for Achieving Battery Efficiency of FE-CR-Redox Flow," Int. J. of Aquatic Science (Jun. 1, 2021), vol. 12, No. 2, pp. 535-540. (Year: 2021).

Search report for corresponding EP Application No. 23162221.8 dated Aug. 21, 2023.

Stepan, "Low Foaming" (© 2017), pp. 1-2 (Year: 2017).

* cited by examiner

METHOD OF INHIBITING TARNISH FORMATION AND CORROSION

The present divisional application claims priority to patent application Ser. No. 17/703,774, filed Mar. 24, 2022, now abandoned.

FIELD OF THE INVENTION

The present invention is directed to a method of inhibiting tarnish formation of silver and corrosion of gold. More specifically, the present invention is directed to a method of inhibiting tarnish formation of silver and corrosion of gold by depositing a layer of bismuth on the silver or gold to a sufficient thickness to inhibit tarnish formation of silver and corrosion of gold and maintain good electrical performance even after thermal aging.

BACKGROUND OF THE INVENTION

Silver is used as a metal finish for applications in the electronics industry. Connector and lead-frame parts can include silver finish because of its excellent electrical properties. There are also financial incentives to use silver because it is significantly less expensive than gold. The major drawback to silver is its propensity to tarnish, leading to a disfiguring layer on the surface that is visually unacceptable and insulating, thus destroying the electrical performance of the silver when applied as a finish on an electrical component. The main product of silver tarnishing is silver sulfide caused by the presence of sulfides, such as hydrogen sulfide, present in the atmosphere via the half reactions $8Ag+4HS^{-} \leftrightarrow 4Ag_2S+2H_2+4e^{-}$ and $O_2+2H_2O+4e^{-} \leftrightarrow 4OH^{-}$. In dry air, tarnishing does not take place. In the presence of water (relative humidity between 5 to 50% or greater), oxygen acts as a cathodic species and consumes electrons as indicated in the equation. Higher concentrations of hydrogen sulfide increase tarnishing. Although the rate of tarnishing gradually declines with increased tarnish layer thickness, the reaction proceeds even on a heavily tarnished surface. Owing to its coarse structure, the silver sulfide does not form a protective layer against surface corrosion.

Accordingly, silver applications require the use of an anti-tarnish post-treatment for the silver surface. Historically, organic anti-tarnish treatments for silver have consisted of aliphatic thiols. These molecules form compact self-assembled monolayers due to the high enthalpy of the silver-sulfur bond, and the van der Waals interactions of the hydrocarbon tails of the long-chain aliphatic thiol molecule. The hydrophobicity of the resulting monolayer prevents tarnish of the silver by blocking water from interacting with the silver surface. However, this technique suffers due to the long process times needed for monolayers to form, and the necessity of organic, flammable solvents to dissolve the long-chain thiols as the working solution. The other major drawback to using organic molecules as anti-tarnish post treatments is their thermal instability. Organic molecules evaporate or decompose upon heating over 100° C. Aliphatic carbon-hydrogen bonds in long hydrocarbon chains may also oxidize under hot oxygen-containing atmospheres, thus decomposing and failing as a post-treatment for silver.

As an alternative to organic post-treatments, metallic or inorganic treatments have also been disclosed. Unlike typical organic post-treatments, metal coatings do not suffer from volatility under high temperatures. Metal oxide layers of zinc, titanium, or aluminum have been used to prevent tarnish. Chromium (VI) is another historical coating component but has become unpopular due to toxicity. Additionally, precious metals can also protect a silver surface. These thin coatings are typically electroplated as an inert topcoat to protect the silver from interacting with sulfur or moisture, thus no tarnish of the silver is observed as disclosed in EP2196563, U.S. 20020185716, U.S. 20170253983, and U.S. Pat. No. 10,056,707B2. Thin coatings of these metals can also preserve the bright appearance of the silver. The main drawback to these treatments is the cost associated with the precious metal coatings. Additionally, heating may cause intermetallics to form. In this way, thermal instability is not associated with the post-treatment evaporating, but by diffusing into the silver and hurting its electrical performance (i.e., increasing the contact resistance).

Hard gold or gold alloys of cobalt and nickel have been widely used as contact material of electrical connectors for high reliability applications. Connectors having hard gold end layers are often electroplated over nickel substrates, such as nickel plated on copper. In general, selective plating techniques, such as spot plating, significantly reduce material cost of connectors by limiting the plating area of gold and other precious metals, such as palladium and palladium-nickel alloys. Although hard gold does not tarnish as silver, hard gold is often a thin, porous surface through which the nickel underlayer can corrode and compromise the performance of electrical connectors Accordingly, there is a need for a method of inhibiting tarnish formation of silver and nickel underlayer pore corrosion with gold or gold alloy topcoats.

SUMMARY OF THE INVENTION

A method of electroplating bismuth comprising: providing a substrate comprising silver, silver alloy, gold or gold alloy; providing a bismuth electroplating bath comprising a source of bismuth ions, an acid, salt of an acid or combinations thereof, contacting the substrate with the bismuth electroplating bath, applying a current to the bismuth electroplating bath and substrate, and electroplating bismuth on the silver, silver alloy, gold or hard gold of the substrate to a thickness of greater than 0 to less than or equal to 20 nm.

A bismuth electroplating bath consisting of a source of bismuth ions, an acid, salt of an acid or combinations thereof, water, optionally a surfactant, optionally a brightener, optionally an antimicrobial, optionally an antifoam.

An article comprising a layer of silver, silver alloy, gold or gold alloy, having a bismuth layer adjacent the silver, silver alloy or hard gold of a monolayer to less than or equal to 20 nm.

The bismuth layer on the silver, silver alloy, gold or gold alloy inhibits silver tarnish and corrosion of the gold and provides low contact resistance to enable good electrical performance even after thermal aging.

DETAILED DESCRIPTION OF THE INVENTION

Figure 1:
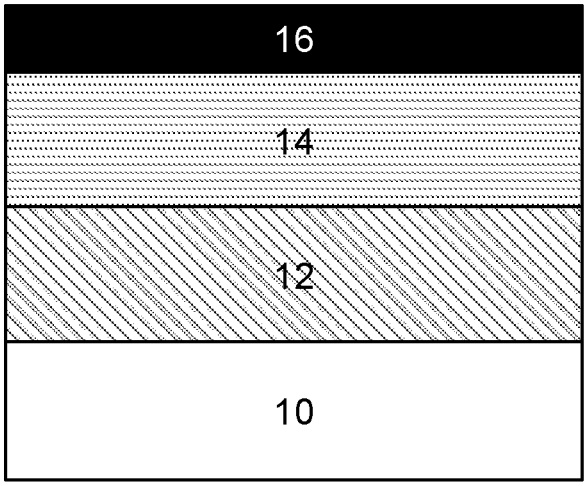
FIG. 1 is a diagram of a metal layer sequence of the present invention with a brass base, nickel barrier layer adjacent the brass base, silver layer adjacent the nickel barrier layer and a bismuth layer adjacent to the silver layer.

The following abbreviations have the following meanings unless the context clearly indicates otherwise: ° C.=degrees Celsius; g=grams; mL=milliliter; L=liter; A=amperes; dm=decimeter; ASD=ampere/$dm^2$, mΩ=milliohms; nm=nanometers; μm=microns; cm=centimeters; cN=centinewton; sec=second; DI=deionized; DC=direct current; XRF=X-Ray Fluorescence; bismuth ions=bismuth (III)=$Bi^{3+}$; wt %=weight percent; ASTM=American Standard Testing Method; and NA=not available or not applicable.

All percentages and ratios are by weight unless otherwise indicated. All ranges are inclusive and combinable in any order except where it is logical that such numerical ranges are constrained to add up to 100%.

As used throughout this specification, the terms "plating" and "electroplating" are used interchangeably. The indefinite articles "a" and "an" are intended to include both the singular and the plural. The term "adjacent" means next to or adjoining to have a common interface. The term "contact resistance" means contribution to the total resistance of a system which can be attributed to the contacting interfaces of electrical leads and connections. The term "applied normal force" means a force that is applied to an object by a person or another object, i.e., gravity force or weight. The term "centinewton" is a unit of measurement of force. The term "ohm" is an SI derived unit of electrical resistance. The term "monolayer" means a layer one molecule thick.

Bismuth electroplating baths of the present invention comprise (preferably consist of) water, a source of bismuth (III) ions, an acid, optionally a brightener, optionally a surfactant. The bath is free of alloying metals, thus the deposits plated from the baths of the present invention are substantially 100% bismuth.

The sources of bismuth provide bismuth (III) ($Bi^{3+}$) ions and a corresponding counter anion. Preferably the sources of bismuth (III) ions are water soluble. Sources of bismuth (III) ions include, but are not limited to, bismuth salts of alkane sulfonic acids such as bismuth methanesulfonate, bismuth ethanesulfonate, bismuth propanesulfonate, 2-bismuth propane sulfonate and bismuth p-phenolsulfonate, bismuth salts of alkanolsulfonic acids such as bismuth hydroxymethanesulfonate, bismuth 2-hydroxyethane-1-sulfonate and bismuth 2-hydroxybutane-1-sulfonate, and bismuth salts such as bismuth nitrate, bismuth sulfate and bismuth chloride. Mixtures of the sources of bismuth (III) ions can also be included in the bismuth electroplating baths of the present invention. More preferably, the source of bismuth (III) ions is selected from the group consisting of bismuth methanesulfonate, bismuth ethanesulfonate, bismuth propanesulfonate and mixtures thereof. Most preferably, the source of bismuth (III) ions is bismuth methanesulfonate.

Preferably, bismuth salts are included in the plating baths to provide bismuth (III) ions in amounts of 1-200 g/L, more preferably, from 1-150 g/L, still more preferably, from 1-100 g/L, even more preferably, from 1-50 g/L, further preferably, from 1-25 g/L, most preferably, from 1-10 g/L. Such bismuth salts are commercially available or may be made according to disclosures in the chemical literature. They are generally commercially available from a variety of sources, such as Aldrich Chemical Company, Milwaukee, Wisconsin.

Acids included in the bismuth baths are organic, inorganic or mixtures thereof. Salts of the organic and inorganic acids also can be included in the bismuth electroplating baths of the present invention. Mixtures of the acids and salts also can be included in the bismuth electroplating baths of the present invention. Preferably, organic acids and salts thereof are included in the bismuth electroplating baths of the present invention. Preferably, organic acids include, but are not limited to, alkane sulfonic acids, alkanol sulfonic acids and aromatic sulfonic acids. Alkane sulfonic acids include, but are not limited to, methanesulfonic acid, ethanesulfonic acid, propanesulfonic acid, 1-propanesulfonic acid, 2-propanesulfonic acid, 1-butanesulfonic acid, 2-butanesulfonic acid, pentanesulfonic acid, hexane sulfonic acid, decane sulfonic acid and dodecane sulfonic acid. Alkanol sulfonic acids include, but are not limited to, 1-hydroxy propane-2-sulfonic acid, 3-hydroxypropane-1-sulfonic acid, 4-hydroxybutane-1-sulfonic acid, 2-hydroxyhexane-1-sulfonic acid, 2-hydroxydecane-1-sulfonic acid, 2-hydroxy-dodecane-1-sulfonic acid, 2-hydroxyethane-1-sulfonic acid, 2-hydroxypropane-1-sulfonic acid, 2-hydroxybutane-1-sulfonic acid and 2-hydroxypentane-1-sulfonic acid. Aromatic sulfonic acids include, but are not limited to, benzenesulfonic acid, alkylbenzenesulfonic acid, phenolsulfonic acid, cresol sulfonic acid, sulfosalicylic acid, nitrobenzenesulfonic acid, sulfobenzoic acid, and diphenylamine-4-sulfonic acid. Preferably the organic acids are alkane sulfonic acid. More preferably, the alkane sulfonic acids are selected from the group consisting of methanesulfonic acid, ethanesulfonic acid, propanesulfonic acid, salts thereof and mixtures thereof. Most preferably, the alkane sulfonic acid is methanesulfonic acid or salts thereof.

Preferably the organic acids are water soluble. Preferably, organic acids and salts thereof are included in the baths in amounts of 1-1000 g/L, more preferably, from 5-500 g/L, still more preferably, from 10-250 g/L, even more preferably, from 10-100 g/L, most preferably, from 10-60 g/L. Such acids as described above may be obtained commercially or may be made according to disclosures in the chemical literature. They are generally commercially available from a variety of sources, such as Aldrich Chemical Company, Milwaukee, Wisconsin.

Inorganic acids include, but are not limited to, sulfuric acid, nitric acid, hydrochloric acid, sulfamic acid and salts thereof. Preferably the inorganic acid is sulfuric acid and salts thereof. Preferably, inorganic acids and salts thereof can be included in the baths in amounts of 10-200 g/L, more preferably, from 20-100 g/L, further preferably, from 30-70 g/L.

The pH of the bismuth electroplating baths of the present invention range from less than or equal to 7, preferably, less than 7, more preferably, from 0-6, even more preferably, from 0-2 and, most preferably, from 0 to less than 2.

Optionally, but preferably, the bismuth electroplating baths of the present invention include a surfactant. Preferably, the surfactants are chosen from polyoxyethylene aryl ethers, such as the commercial product ADEKA™ TOL PC-8, available from Adeka Corporation, amine oxides, such as the commercial product TOMAMINE™ AO-455, available from Evonik Operations GmbH, branched alcohol alkoxylated nonionic surfactants, such as the commercial product TERGITOL™ CA; polyether polyols, such as the commercial product TERGITOL™ L-64; secondary alcohol ethoxylates, such as the commercial product TERGITOL™ 15-S-7; nonionic-low foam, surfactants such as TRITON™ CF-87, which contains poly(oxy-1,2-ethanediyl), alpha-(phenylmethyl)-omega-(1,1,3,3-tetramethylbutyl)phenoxy, polyethylene glycol octylphenyl ether, and decanoic acid in a mixture, all available from the Dow Chemical Company, Midland MI; mixtures of organic and inorganic compounds, such as Wetting Agent W, which contains sodium dodecylphenyl-sulfonate; and Wetting Agent NAW-4 which includes 5-chloro-2-methyl-4-isothiazolin-3-one and 2-methyl-2H-isothiazol-3-one in a mixture, also available from the Dow Chemical Company. Preferably, the surfactants are nonionic surfactants.

Surfactants can be included in the bismuth electroplating baths in conventional amounts. Preferably, surfactants are included in amounts of 0.1-2 g/L, more preferably, from 0.5-2 g/L, even more preferably from 0.5-1 g/L.

Optionally, antifoam agents can be included in the bismuth baths. Conventional antifoam agents can be used and are included in conventional amounts. Antifoams are preferably included in amounts of 10-100 mg/L. An example of a preferred commercially available antifoam is FOAM BAN® MS-293 antifoam available from Inwoo Corporation, Gobiz Korea which includes 5-decyne 4,7-diol, 2,4,7,9-tetramethyl (less than 2.5 wt %) and ethylene glycol (less than 2.5 wt %) mixture.

Optionally, the bismuth electroplating baths of the present invention can include a brightener. Conventional brighteners can be included in the bismuth electroplating baths. Preferably, the brighteners are selected from the group consisting of 5-sulfosalicylic acid, cysteine, 1,6-hexanediol, thiodiethanol, 4,5-dihydroxy-1,3-benzenedisulfonic acid, 2,2-bis(hydroxymethyl)propionic acid, taurine, thiodiglycolic acid, salts thereof and mixtures thereof. More preferably, the brighteners are selected from the group consisting of 5-sulfosalicylic acid, 4,5-dihydroxy-1,3-benzenedisulfonic acid, thiodiglycolic acid, salts thereof and mixtures thereof.

Brighteners can be included in conventional amounts. Preferably, brighteners are included in the bismuth electroplating baths in amounts of 0.5-20 molar equivalents of bismuth (III) ions in the bismuth electroplating bath. More preferably, the brighteners are included in amounts of 0.5-15 molar equivalents or bismuth (III) ions in the bismuth electroplating bath, even more preferably, the brighteners are included in amounts of 0.5-10 molar equivalents of bismuth (III) ions in the bismuth electroplating bath.

Optionally, the bismuth electroplating bath includes one or more antimicrobials. Conventional antimicrobials typically included in electroplating baths may be used. Such antimicrobials are well known in the art. They are used in conventional amounts.

Bismuth can be plated from the electroplating baths of the present invention on silver, silver alloy, hard gold and soft gold at current densities of 0.1 ASD and higher. Preferably, bismuth can be plated at current densities of 0.1-5 ASD, more preferably, from 0.1-3 ASD, most preferably, from 0.1-1 ASD.

Preferably, bismuth electroplating is done at bath temperatures from room temperature to 60° C., more preferably, from room temperature to 50° C., further preferably, from 30-50° C., most preferably from 35-45° C.

The bismuth layer adjacent the silver, silver alloy, hard gold and soft gold ranges from greater than 0 to 20 nm, or such as a monolayer containing bismuth to 20 nm, preferably, greater than 1 to 20 nm, more preferably, from greater than 1 to 10 nm, further preferably, from greater than 1 to 7 nm, most preferably, the bismuth layer has a thickness of 1 to 5 nm. In addition to bismuth metal deposited adjacent the silver, silver alloy, hard gold and soft gold, the deposit can include bismuth (III) ions.

The bismuth layer adjacent the silver or silver alloy inhibits tarnish formation on the silver or silver alloy, and the bismuth layer adjacent the hard gold or soft gold inhibits corrosion of the gold. This enables the silver, silver alloy, hard gold and soft gold to maintain a low contact resistance under applied normal forces, such as at 100 cN to provide good electrical conductivity. Further, the bismuth layer of the present invention inhibits tarnishing of silver and silver alloy as shown by the conventional accelerated sulfidation test by immersing the substrate into a solution of aqueous 2 wt % potassium polysulfide. The bismuth layer inhibits tarnish formation even after thermal aging as shown by conventional thermal aging tests. The bismuth layer also prevents corrosion of hard gold as evidenced by the conventional nitric acid vapor (NAV) and sulfur dioxide vapor tests, even after thermal aging as shown by conventional thermal aging tests.

Preferably, silver is substantially about 98-99.9 wt % silver. Silver can be deposited on a substrate or article by conventional methods known in the art. Preferably, silver is deposited by electroplating from silver electroplating baths.

Silver plating baths include silver ions which can be provided by silver salts such as, but not limited to, silver cyanide, potassium silver cyanide, silver oxide, silver hydantoin, silver succinimide, silver halides, silver gluconate, silver citrate, silver lactate, silver nitrate, silver sulfates, silver alkane sulfonates, silver alkanol sulfonates or mixtures thereof. When a silver halide is used, preferably, the halide is chloride. Mixtures of silver salts can also be included in the compositions. The silver salts are generally commercially available or can be prepared by methods described in the literature, are readily water-soluble, and are included in the aqueous silver electroplating compositions in conventional amounts and are well known to those of skill in the art. Silver electroplating baths can contain conventional additives such as electrolytes, complexing agents, buffers, and brighteners. Such additives are included in conventional amounts and are well known to those skilled in the art. Examples of commercially available silver electroplating baths are SILVERON™ GT-101 Bright Silver, or SILVERGLO™ 3K Bright Silver (both available from Dupont Electronic & Industrial, Marlborough, MA).

Preferably, current densities for electroplating the silver layers can range from 0.1 ASD to 50 ASD, or such as from 1 ASD to 5 ASD. Preferably, silver plating bath temperatures can range from room temperature to 50° C. Preferably, silver layers range from 0.1 μm to 20 μm.

Silver alloys include, but are not limited to, silver-tin, silver-indium, silver-nickel and silver-gold. Preferably, the silver alloy is silver-tin alloy. Preferably, the silver-tin alloy has a silver content of about 70-95 wt % silver with the remainder tin and minor impurities.

Silver-tin alloy can be deposited on a substrate by conventional methods known in the art. Preferably, silver-tin alloys are electroplated from silver-tin electroplating baths. Such electroplating baths one or more sources of silver ions.

Sources include, but are not limited to, silver salts such as, but are not limited to, silver halides, silver gluconate, silver citrate, silver lactate, silver nitrate, silver sulfates, silver alkane sulfonates and silver alkanol sulfonates. The silver salts are generally commercially available or can be prepared by methods described in the literature. Preferably, silver salts in the bath can range from 1 g/L to 100 g/L.

Preferably, sources of tin ions include, but are not limited to salts, such as tin halides, tin sulfates, tin alkane sulfonates, tin alkanol sulfonates, and acids. The tin salts are generally commercially available or can be prepared by methods known in the literature. Preferably, tin salts can range from 0.1 g/L to 80 g/L. The silver/tin alloy electroplating baths can also include one or more conventional bath additives included in conventional amounts well known in the art. Preferably, current densities for electroplating the silver-tin layers can range from 0.1 ASD to 50 ASD, or such as from 1 ASD to 5 ASD. Preferably, silver-tin plating bath temperatures can range from room temperature to 50° C. An example of a commercially available hard gold alloy electroplating bath is SILVERON™ GT-820 Silver-Tin (available from Dupont Electronic & Industrial, Marlborough, MA). Preferably, silver-tin layers range from 0.1 μm to 20 μm.

Hard gold is an alloy of gold-cobalt or gold-nickel. The gold-cobalt alloys, preferably, have a gold content of about 98-99.95 wt % and a cobalt content of about 0.01-2 wt %. The gold-nickel alloys, preferably, have a gold content of about 98-99.95 wt % and a nickel content of about 0.01-2 wt %. Most preferably the hard gold alloy is composed of 0.1 wt % to 0.4 wt % cobalt with the remainder gold.

Hard gold can be deposited on substrates by conventional methods known in the art. Preferably, hard gold is electroplated on a substrate using a gold-cobalt alloy electroplating bath. Sources of gold ions for the bath include, but are not limited to potassium gold cyanide, sodium dicyanoaurate (I), ammonium dicyanoaurate (I) and other dicyanoauric acid (I) salts; potassium tetracyanoaurate (III), sodium tetracyanoaurate (III), ammonium tetracyanoaurate (III) and other tetracyanoauric acid (III) salts; gold (I) cyanide, gold (III) cyanide; dichloroauric acid (I) salts; tetrachloroauric acid (III), sodium tetrachloroaurate (III) and other tetrachloroauric acid (III) compounds; ammonium gold sulfite, potassium gold sulfite, sodium gold sulfite and other sulfurous acid gold salts; gold oxide, gold hydroxide and other alkali metal salts thereof; and nitrosulphito gold complexes. Preferably, gold sources are included in conventional amounts such as 3 g/L to 8 g/L.

The gold alloy electroplating baths can also include conventional additives such as, but not limited to surfactants, brighteners, levelers, complexing agents, chelating agents, buffers, organic acids and inorganic acids and biocides. Such additives are included in conventional amounts and are well known to those of skill in the art. An example of a commercially available hard gold alloy electroplating bath is RONOVEL™ CM Cobalt-Alloyed Electrolytic Gold (available from Dupont Electronic & Industrial, Marlborough, MA).

The hard gold alloy electroplating can be plated at current densities, preferably, from 0.1 ASD to 10 ASD, more preferably, from 0.5 ASD to 3 ASD, and temperatures of 30° C. to 60° C. The pH of the hard gold alloy electroplating baths can range from 4 to 8.

Preferably, soft gold or gold is about 98-99.9 wt % gold with the remainder unavoidable impurities. Soft gold or gold can be deposited on a substrate using conventional methods known in the art. Preferably, the soft gold or gold is electroplated on a substrate. Sources of gold ions are the same as those described above for the hard gold. Sources of gold ions can be included in the plating baths in conventional amounts. Plating baths for the soft gold and gold can also include surfactants, brighteners, levelers, complexing agents, chelating agents, buffers, organic acids and inorganic acids and biocides. Such additives are included in conventional amounts and are well known to those of skill in the art. A commercially available soft gold bath is AURONAL™ BGA LF gold electroplating bath (available from Dupont Electronic & Industrial, Marlborough, MA).

Substrates containing silver, silver alloy, hard gold or soft gold are contacted with the bismuth electroplating baths of the present invention by any suitable method known in the art, such as by immersing the substrate in the bath or by spraying the bath on the substrate. Insoluble electrodes, such as an insoluble platinized titanium electrode can serve as an anode. Bismuth plating is done according to the parameters described above to deposit a layer of bismuth adjacent to the silver, silver alloy, hard gold or soft gold.

While it is envisioned that the bismuth electroplating baths of the present invention can be used to plate bismuth on any suitable substrate containing a silver, silver alloy, hard gold or soft gold layer, preferably, the method of the present invention is used to deposit bismuth adjacent to silver, silver alloy or hard gold of lead frames or similar electronic components. Such electronic components, preferably, include a brass base of copper-zinc alloys, optionally a nickel barrier layer with a top layer of silver or silver alloy. The nickel barrier layer, silver layer and silver alloy layer are deposited using conventional plating compositions and methods well known in the art, such as electroplating.

Nickel barrier layers can be deposited by conventional methods known in the art. Preferably, nickel barrier layers are deposited by electroplating from nickel baths. A source of nickel ions for the nickel electroplating baths includes, but are not limited to, nickel sulfate or its hydrated form, nickel sulfamate or its hydrated form, nickel chloride hexahydrate, nickel methanesulfonate, or nickel acetate or its hydrated form. One or more sources of nickel ions are included in the aqueous nickel electroplating compositions in conventional amounts and are well known to those of skill in the art. The nickel baths can include conventional additives such as, but not limited to, surfactants, brighteners, levelers, complexing agents, chelating agents, buffers and biocides. Such additives are included in conventional amounts and are well known to those skilled in the art. Examples of commercially available nickel electroplating baths are NIKAL™ PC-3 Bright Nickel and NIKAL™ SC Nickel (both available from Dupont Electronic & Industrial, Marlborough, MA).

Preferably, current density for electroplating the nickel layers is 0.5 ASD to 20 ASD, or such as from 1 ASD to 10 ASD. Preferably, nickel plating baths are electroplated at temperatures from room temperature to 60° C.

Articles of the present invention, as shown in FIG. 1, include a base 10 of brass. The brass base, preferably, contains a copper-zinc alloy. Adjacent to the base 10 is an optional nickel barrier layer 12. Preferably, the nickel barrier ranges in thickness of 0-2 μm. The silver layer 14 adjacent the nickel barrier layer, preferably, has a thickness of 0.5-7 μm. The bismuth layer 16 adjacent the silver layer 14, preferably, has a thickness of greater than 1-20 nm.

Figure 2:
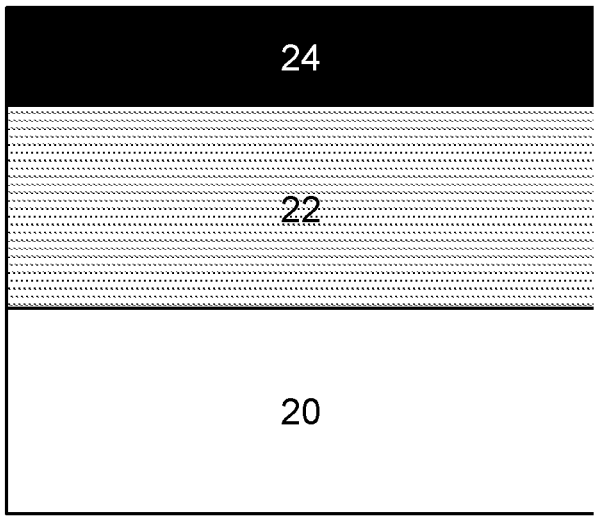
FIG. 2 is a diagram of a metal layer sequence of the present invention with a brass base, silver layer adjacent the brass base and a bismuth layer adjacent the silver layer.

FIG. 2 illustrates an article of the present invention which excludes the nickel barrier layer. A brass base 20, preferably, includes a copper-zinc alloy. A silver layer 22 is adjacent to the brass base 20 and a bismuth layer 24 is adjacent the silver layer 22. The thickness of the metal layers is of substantially the same thickness ranges as in FIG. 1.

Figure 3:
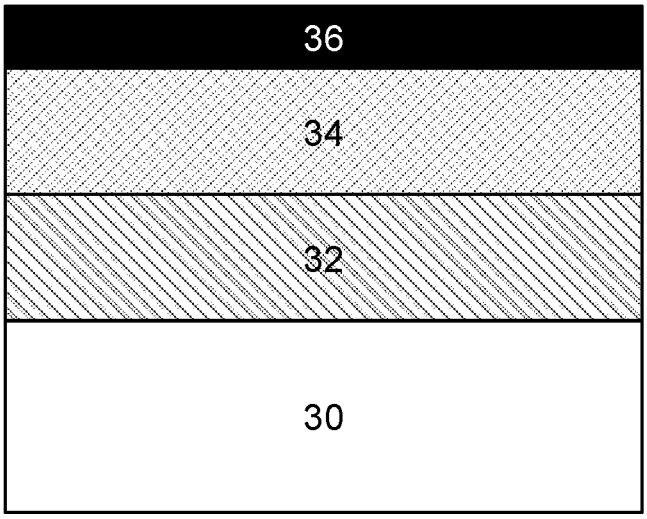
FIG. 3 is a diagram of a metal layer sequence of the present invention with a brass base, nickel barrier layer adjacent the brass base, silver alloy layer adjacent the nickel barrier layer and a bismuth layer adjacent to the silver alloy layer.

FIG. 3 illustrates an article of the present invention including a brass base 30, preferably, of a copper-zinc alloy. Adjacent the brass base 30 is a nickel barrier layer 32. Adjacent the nickel barrier layer 32 is a silver-tin alloy layer 34. A bismuth layer 36 is adjacent the silver-tin alloy layer.

Figure 4:
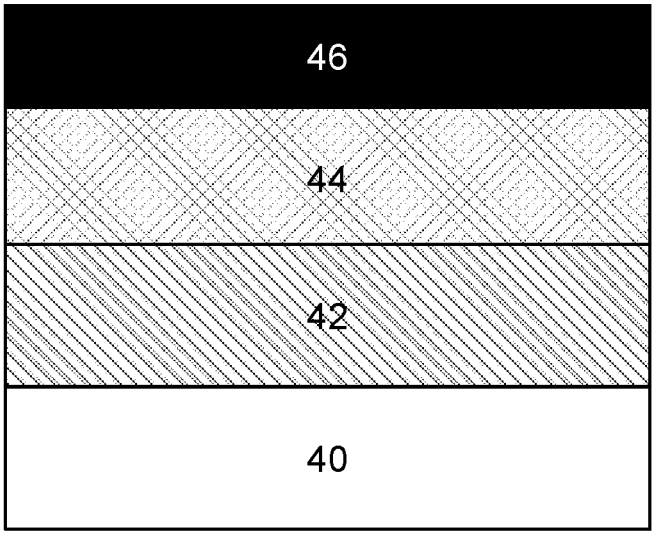
FIG. 4 is a diagram of a metal layer sequence of the present invention with a brass base, nickel barrier layer adjacent the brass base, a hard gold layer adjacent the nickel barrier layer and a bismuth layer adjacent the hard gold layer.

FIG. 4 illustrates an article of the present invention including a brass base 40, preferably, of a copper-zinc alloy. Adjacent the brass base 40 is a nickel barrier layer 42. Adjacent the nickel barrier layer 42 is hard gold layer 44. A bismuth layer 46 is adjacent the hard gold layer 44.

Figure 5:
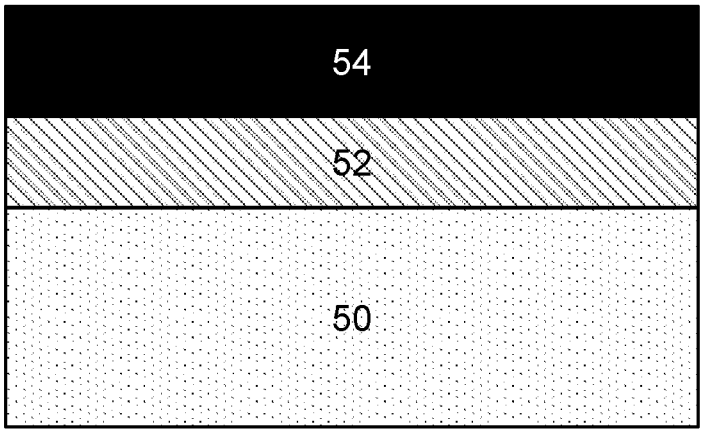
FIG. 5 is a diagram of a metal layer sequence of the present invention with a copper-iron-phosphorous-zinc base (copper-C-194), a silver layer adjacent the copper-iron-phosphorous-zinc base and a bismuth layer adjacent the silver layer.

A further article of the present invention is illustrated in FIG. 5. The base includes brass of a copper-iron-phosphorous-zinc alloy (copper-C194) 50. Adjacent the brass base is a layer of silver 52, and adjacent the silver layer 52 is a bismuth layer 54.

The following examples are included to illustrate the invention but are not intended to limit the scope of the invention.

Example 1

A plurality of brass substrates of copper-zinc alloy 3 cm×4 cm were electroplated with a nickel barrier layer of 1 μm from the nickel electroplating baths NIKAL™ PC-3 Bright Nickel, or NIKAL™ SC Nickel. The current density for electroplating the nickel layers was 4 ASD. The nickel plating baths were at 50° C.

A silver layer of 2 μm was plated on the nickel layers from silver electroplating baths SILVERON™ GT-101 Bright Silver, or SILVERGLO™ 3K Bright Silver electroplating baths. The current density for electroplating the silver layers was 2 ASD at 50° C.

The thicknesses of the nickel and silver layers were measured by XRF using a BOWMAN® P-Series fluorescence analyzer. The contact resistance of the substrate was measured according to the conventional ASTM B667 method over an applied normal force of 0-100 cN. The applied force was controlled using a Starrett DFC-20 force gauge. The resistance was measured using a Keithley 2010 Multimeter, using a gold reference probe contact.

The substrates were then immersed into an accelerated sulfidation test solution of aqueous 2 wt % potassium polysulfide for five minutes at room temperature. The substrates were removed from the sulfidation test solution, rinsed with DI water and air dried. The silver discolored to a dark blue appearance. The contact resistance was measured over an applied normal force of 0-100 cN. The contact resistance of the tarnished silver had significantly higher contact resistance values than the untarnished silver. At 100 cN applied force, the contact resistance of the tarnished silver was about 8 mΩ. In contrast, the contact resistance of the untarnished silver was only 1.5 mΩ (Table 1).

TABLE 1

| Applied Normal Force (cN) | Silver Contact Resistance (mΩ) | Tarnished Silver Contact Resistance (mΩ) |
|---|---|---|
| 0 | 10 | 600 |
| 10 | 5 | 500 |
| 15 | 4 | 100 |

TABLE 1-continued

| Applied Normal Force (cN) | Silver Contact Resistance (mΩ) | Tarnished Silver Contact Resistance (mΩ) |
|---|---|---|
| 20 | 3.5 | 50 |
| 30 | 3 | 30 |
| 40 | 2.5 | 15 |
| 50 | 2 | 10 |
| 100 | 1.5 | 8 |

Example 2

Brass copper-zinc alloy substrates 3 cm×4 cm were electroplated with nickel to a thickness of 1μ and then with silver to a thickness of 2 μm as described in Example 1. The thickness of the silver layer was measured by XRF using a BOWMAN® P-Series fluorescence analyzer. The contact resistance of the substrates was measured over an applied normal force of 0-100 cN as described in Example 1. The results are shown in Table 3 below.

An aqueous bismuth electroplating bath was prepared as shown in the table below.

TABLE 2

| Component | Amount |
|---|---|
| Methane sulfonic acid | 234 g/L |
| Bismuth (III) ions from bismuth methane sulfonate | 5 g/L |
| Polyether polyol[1] | 2 g/L |
| Water | To desired volume |
| pH | 1-2 |

[1]TERGITOL ™ L-64 non-ionic surfactant available from the Dow Chemical Company, Midland, MI.

The bath was heated to 40° C. An insoluble platinized titanium anode was immersed into the bath and connected to a DC power supply. The silver plated substrates were immersed in the bismuth electroplating bath and functioned as the cathode. A current density of 0.2 ASD was applied for 5 seconds to plate a 10 nm layer of bismuth on the silver. The current was powered off and the substrate removed, washed with DI water, and air dried. The contact resistance was promptly measured.

The bismuth plated substrates were then heated for 18 hours at 125° C. in a conventional laboratory oven and the contact resistance was measured. The substrates were then subjected to the accelerated sulfidation test, and the contact resistance measured again. The appearance of the substrates remained bright and gray in color. The contact resistance measured 1.5 mΩ at 100 cN applied normal force, comparable to freshly plated pure silver (Table 3).

TABLE 3

| Normal Force (cN) | Electroplated Silver (mΩ) | Bismuth Plated Silver (mΩ) | Heated Bismuth Plated Silver (mΩ) | After accelerated sulfidation (mΩ) |
|---|---|---|---|---|
| 1 | 10 | 10 | 10.5 | 20 |
| 10 | 5 | 5.5 | 9.5 | 12 |
| 15 | 4 | 5 | 8 | 8 |
| 20 | 3 | 4 | 5 | 5 |

TABLE 3-continued

| Normal Force (cN) | Electroplated Silver (mΩ) | Bismuth Plated Silver (mΩ) | Heated Bismuth Plated Silver (mΩ) | After accelerated sulfidation (mΩ) |
|---|---|---|---|---|
| 30 | 2.5 | 3 | 4.5 | 4 |
| 40 | 2 | 2.5 | 2 | 3 |
| 50 | 1.5 | 2 | 1.5 | 2 |
| 100 | 1.25 | 1.5 | 1.5 | 2 |

Example 3

Brass copper-zinc alloy substrates 2.5 cm×3.8 cm were electroplated with nickel to 1 μm and then with silver to a thickness of 2 μm as described in Example 1. The thickness of the silver layer was measured by XRF using a BOWMAN® P-Series analyzer. The contact resistance of the substrates was measured over an applied normal force of 0-100 cN as described in Example 1 with data shown in Table 5 below.

The silver plated substrates were then heat treated for 10 minutes at 270° C. in a conventional laboratory oven. The substrates were cooled to room temperature. The substrates were then immersed into an accelerated sulfidation test solution of aqueous 2 wt % potassium polysulfide for five minutes at room temperature. The substrates were removed from the sulfidation test solution, rinsed with DI water and air dried. The contact resistance was measured over an applied normal force of 0-100 cN, as disclosed in Table 5 below.

An aqueous bismuth electroplating bath was prepared as shown in the table below.

TABLE 4

| Component | Amount |
|---|---|
| Methane sulfonic acid | 11.7 g/L |
| Bismuth (III) ions from bismuth methane sulfonate | 5 g/L |
| 2,2'-bis(hydroxymethyl) propionic acid[2] | 64 g/L |
| Water | To desired volume |
| pH | 2 |

[2]Brightener

Brass copper-zinc alloy substrates 2.5 cm×3.8 cm with a 1 μm layer of nickel and 2 μm topmost layer of silver were plated with a 10 nm layer of bismuth. The bath was heated to 40° C. A platinized titanium anode was immersed into the bath and connected to a DC power supply as an anode. The silver-plated substrates were immersed in the bath and connected to the cathode wire. A current density of 0.2 ASD was applied for 5 sec. The potential was turned off and the substrates removed, washed with DI water, and dried. The substrates were then heat treated for 10 minutes at 270° C. in a conventional laboratory oven. The substrates were cooled to room temperature, then subjected to the accelerated sulfidation test, and the contact resistance was measured. The data is disclosed in Table 5 below. Appearance of the bismuth-treated substrate remained bright and gray in color.

A comparison with octadecanethiol as a post-treatment was also conducted. Brass copper-zinc alloy substrates 2.5 cm×3.8 cm with a 1 μm layer of nickel and 2 μm topmost layer of silver were plated and then immersed in a solution containing 0.1 M octadecanethiol emulsified by Triton X-114 (40 g/L) emulsified by TRITON™ X-114 non-ionic surfactant (40 g/L) at 30° C. for 30 seconds. The substrate was heated for 10 minutes at 270° C. in a conventional laboratory oven, then subjected to the accelerated sulfidation test, rinsed with DI water and air dried. The contact resistance was measured over an applied normal force of 0-100 cN as disclosed in Table 5 below.

Substrates heated under the same conditions with no post-treatment or with octadecanethiol post-treatment turned purple after the accelerated sulfidation test. The bismuth-containing post-treatment maintained bright appearance and low contact resistance after heating and sulfidation of 1 mΩ at an applied normal force of 100 cN.

TABLE 5

| Normal Force (cN) | Silver (mΩ) | Silver After Accelerated Sulfidation (mΩ) | Octadecanethiol treated Silver After Accelerated Sulfidation (mΩ) | Bismuth Plated Silver After Accelerated Sulfidation (mΩ) |
|---|---|---|---|---|
| 0 | 12 | 200 | 5000 | 12 |
| 10 | 5 | 90 | 1000 | 10 |
| 15 | 4 | 60 | 200 | 9 |
| 20 | 3.5 | 30 | 40 | 6 |
| 30 | 3 | 20 | 20 | 5 |
| 40 | 2 | 15 | 14 | 4 |
| 50 | 1.5 | 12 | 9 | 3 |
| 100 | 1 | 10 | 4.4 | 1 |

Example 4

Brass copper-zinc alloy substrates 2.5 cm×3.8 cm were electroplated with nickel to 1 μm and then silver to a thickness of 2 μm as described in Example 1. The thickness of the silver layer was measured by XRF using a BOWMAN® P-Series fluorescence analyzer. The contact resistance of the substrates was measured over an applied normal force of 0-100 cN as described in Example 1 and reported in Table 7 below The silver plated substrates were then heat treated in air for 1000 hours at 150° C. The substrates were cooled to room temperature. The substrates were then immersed into an accelerated sulfidation test solution of aqueous 2 wt % potassium polysulfide for five minutes at room temperature. The substrates were removed from the sulfidation test solution, rinsed with DI water and air dried. The silver had a purple discolored appearance. The contact resistance was measured over an applied normal force of 0-100 cN, as disclosed in Table 7 below.

An aqueous bismuth electroplating bath was prepared as shown in the table below.

TABLE 6

| Component | Amount |
|---|---|
| Methane sulfonic acid | 47 g/L |
| Bismuth (III) ions from bismuth methane sulfonate | 5 g/L |
| Polyether polyol[3] | 500 ppm |
| Water | To desired volume |
| pH | 1-2 |

[3]TERGITOL ™ L-64 non-ionic surfactant available from the Dow Chemical Company, Midland, MI.

The bath was heated to 40° C. A platinized titanium anode was immersed into the bath and connected to a DC power supply as an anode. Brass substrates of copper-zinc alloy with a layer of nickel layer of 1 μm and silver 2 μm thick were immersed in the bath and connected to a cathode wire. A current density of 0.3 ASD was applied for 5 sec to deposit a bismuth layer 10 nm thick on the silver. The current was turned off and the substrates removed, washed with DI water, and dried. The substrates were heated for 1000 hours at 150° C. in air, then subjected to the accelerated sulfidation test, and the contact resistance was measured. Appearance of the substrates remained bright and gray in color, and the contact resistance measured 1.5 mΩ at 100 cN applied normal force, comparable to pure freshly plated 99.9 wt % silver as shown in Table 7 below.

TABLE 7

| Normal Force (cN) | Silver (mΩ) | Silver After Accelerated Sulfidation (mΩ) | Bismuth Plated Silver (mΩ) |
|---|---|---|---|
| 0 | 10 | 400 | 20 |
| 10 | 8 | 250 | 12 |
| 15 | 6 | 100 | 7 |
| 20 | 3 | 30 | 4 |
| 30 | 2.5 | 15 | 3 |
| 40 | 2 | 13 | 2 |
| 50 | 1.5 | 10 | 1.5 |
| 100 | 1 | 4.5 | 1.5 |

Example 5

Brass copper-zinc alloy substrates 2.5 cm×3.8 cm were electroplated with nickel to 1 μm and then silver to a thickness of 2 μm as described in Example 1. The contact resistance of the substrates was measured over an applied normal force of 0-100 cN as described in Example 1, shown in Table 9 below.

An aqueous bismuth electroplating bath was prepared as shown in the table below.

TABLE 8

| Component | Amount |
|---|---|
| Methane sulfonic acid | 11.7 g/L |
| Bismuth (III) ions from bismuth methane sulfonate | 5 g/L |
| 4,5-dihydroxy-1,3-benzendisulfonic acid disodium salt monohydrate[4] | 39.7 g/L |
| Water | To desired volume |
| pH | 7 |

[4]Brightener.

The bath was heated to 40° C. An insoluble platinized titanium anode was immersed into the bath and connected to a DC power supply as the anode. The silver plated brass substrates were immersed in the bath and connected to a cathode wire. A current density of 0.2 ASD was applied for 5 sec to deposit a layer of bismuth 10 nm thick on the silver. The current was powered off and the substrates removed, washed with DI water, and dried. Contact resistance was promptly measured. The bismuth plated substrates were then heated for 48 hours at 180° C. in a conventional laboratory oven and the contact resistance was measured. The substrates were then subjected to the accelerated sulfidation test, and the contact resistance measured again. Appearance of the bismuth layer on the substrates remained bright and gray in color. The contact resistance measured 1.2 mΩ at 100 cN applied normal force, comparable to plated silver.

TABLE 9

| Normal Force (cN) | Silver (mΩ) | Bismuth Plated Silver (mΩ) | Bismuth Plated Silver, Heat Treated (mΩ) | Bismuth Plated Silver, After Heat and Sulfidation (mΩ) |
|---|---|---|---|---|
| 0 | 13 | 15 | 50 | 24 |
| 10 | 7.1 | 9 | 15 | 10 |
| 15 | 4.9 | 6 | 8.7 | 6.4 |
| 20 | 3.5 | 2 | 4.1 | 3.4 |
| 30 | 2.9 | 1.5 | 2.7 | 2.5 |
| 40 | 2.5 | 1.4 | 2.0 | 1.4 |
| 50 | 2.2 | 1.3 | 1.4 | 1.3 |
| 100 | 1 | 1 | 1.3 | 1.2 |

Example 6

Brass copper-zinc alloy substrates 2.5 cm×3.8 cm were electroplated with nickel using NIKAL™ SC Nickel electroplating bath (Dupont Electronic and Industrial, Marlborough, MA) to 1 μm, then with silver-tin alloy (80 wt % silver and 20 wt % tin) to a thickness of 2 μm using SILVERON™ GT-820 Silver-Tin electroplating bath. A current density of 2 ASD was applied for 2 minutes at 50° C.

The thickness of the silver-tin layer was measured by XRF using a BOWMAN® P-Series fluorescence analyzer. The contact resistance of the substrates was measured over an applied normal force of 0-100 cN as described in Example 1 and disclosed in Table 11.

The silver-tin plated substrates were then heat treated in air for 48 hours at 180° C. The substrates were cooled to room temperature and then immersed into the accelerated sulfidation test solution for five minutes at room temperature. The substrates were removed from the sulfidation test solution, rinsed with DI water and air dried. The silver-tin had a dull gray appearance. The contact resistance was measured over an applied normal force of 0-100 cN.

An aqueous bismuth electroplating bath was prepared as shown in the table below.

TABLE 10

| Component | Amount |
|---|---|
| Methane sulfonic acid | 58.6 g/L |
| Bismuth (III) ions from bismuth methane sulfonate | 5 g/L |
| Polyether polyol[5] | 1 g/L |
| Water | To desired volume |
| pH | 1-2 |

[5]TERGITOL ™ L-64 non-ionic surfactant available from the Dow Chemical Company, Midland, MI.

The bath was heated to 40° C. A platinized titanium anode was immersed into the bath and connected to a DC power supply. 2.5×3.8 cm brass substrates were electroplated with nickel using NIKAL™ SC Nickel electroplating bath to 1 μm by applying a current density of 4 ASD for 2 minutes, with the plating bath at 50° C., then with silver-tin alloy (80 wt % silver and 20 wt % tin) to a thickness of 2 μm from SILVERON™ GT-820 Silver-Tin electroplating bath by applying a current density of 2 ASD for 2 minutes with the electroplating bath run at 50° C. The substrates were then immersed and connected to a cathode wire. A current of 0.4 ASD was applied for 5 sec to deposit 10 nm of bismuth on the silver-tin alloy layers. The potential was turned off and the substrates removed, washed with DI water, and dried. The substrates were heated for 48 hours at 180° C. in a conventional laboratory oven then subjected to the accelerated sulfidation test, and the contact resistance was measured. Appearance of the substrates remained bright and gray in color, and the contact resistance measured <10 mΩ at 100 cN applied normal force.

TABLE 11

| Normal Force (cN) | Silver-Tin (mΩ) | Silver-Tin, Heat Treatment then Sulfidation (mΩ) | Bismuth Plated Silver-Tin, Heat Treatment then Sulfidation (mΩ) |
|---|---|---|---|
| 0 | 54 | 85 | 140 |
| 10 | 20 | 46 | 50 |
| 15 | 11 | 23 | 30 |
| 20 | 5.5 | 12 | 10 |
| 30 | 4.2 | 8.4 | 7.8 |
| 40 | 3.3 | 6.8 | 5 |
| 50 | 2.9 | 5.6 | 3 |
| 100 | 1.7 | 4 | 2.4 |

Example 7

Six brass copper-zinc alloy coupons 2.5 cm×5 cm were electroplated with a layer of nickel to 1 μm thick using NIKAL™ SC Nickel electroplating bath. Nickel plating was done at 4 ASD for 2 minutes at 55° C. A hard gold alloy was plated on the nickel to a thickness of 0.5 μm using RONOVEL™ CM Cobalt-Alloyed Electrolytic Gold. The hard gold alloy was plated at 1 ASD for 4 minutes at a bath temperature of 50° C. The thickness of the nickel and hard gold layers was measured by XRF using a BOWMAN® P-Series fluorescence analyzer.

Four of the plated substrates were post-treated in PORE BLOCKER™ 200 Anti-tarnish formulation corrosion inhibitor (available from Dupont Electronic & Industrial, Marlborough, MA). The substrates were immersed in the anti-tarnish at room temperature for 5 seconds, removed and rinsed with DI water. They were air dried at room temperature.

An aqueous bismuth electroplating bath was prepared as shown in the table below.

TABLE 12

| Component | Amount |
|---|---|
| Methane sulfonic acid | 58.6 g/L |
| Bismuth (III) ions from bismuth methane sulfonate | 5 g/L |
| 5-Sulfosalicylic acid | 38 g/L |
| Akylbenzylsulfonic acid wetting agent[6] | 1.5 g/L |
| Water | To desired volume |
| pH | 1-2 |

[6]Wetting Agent W, wetting agent available from Dupont Electronic & Industrial, Marlborough, MA.

The bath was heated to 40° C. A platinized titanium anode was immersed into the bath and connected to a DC power supply. Two of the post-treated hard gold substrates were immersion in the bath and electrically connected to a cathode wire. A current density of 0.2 ASD was applied for 5 seconds to deposit bismuth layers on the hard gold alloy of 10 nm thick. The current was powered off and the substrates removed, washed with DI water, and air dried at room temperature.

The corrosion tests performed on the plated substrates were nitric acid vapor (NAV) testing according to ASTM B735, and by sulfur dioxide vapor testing according to ASTM B799. The thermal stability of an anti-tarnish post-treatment was evaluated by visually comparing corrosion between substrates which were and were not heated to 180° C. for 48 hours or 125° C. for 18 hours before the corrosion test.

On substrates without any anti-tarnish post-treatment, the nickel underlayers of the hard gold alloy electroplated substrates corroded in both tests. For substrates coated with PORE BLOCKER™ 200 Anti-tarnish Formulation, no nickel underlayer corrosion was observed on the substrate which was not heated. However, substantial underlayer corrosion was observed when the substrates with PORE BLOCKER™ 200 Anti-tarnish Formulation was heated at 125° C. for 18 hours before the corrosion tests. The substrates with the bismuth plating post-treatment did not corrode under ASTM B735 or ASTM B799 conditions with or without a heat treatment. These results are summarized in Table 13.

TABLE 13

| Anti-tarnish Post-treatment | Heat treatment | NAV (ASTM B735) | $SO_2$ vapor (ASTM B799) |
|---|---|---|---|
| None | None | Corrosion | Corrosion |
| None | 180° C., 48 h | Corrosion | Corrosion |
| PORE BLOCKER ™ 200 Anti-tarnish Formulation | None | No corrosion | No corrosion |
| PORE BLOCKER ™ 200 Anti-tarnish Formulation | 125° C., 18 h | Corrosion | Corrosion |
| Bismuth layer | None | No corrosion | No corrosion |
| Bismuth layer | 180° C., 48 h | No corrosion | No corrosion |

Example 8

Brass copper-zinc alloy substrates 2.5 cm×3.8 cm were electroplated with nickel barrier layers 0.5 μm thick using NIKAL™ SC Nickel electroplating bath. A current density of 4 ASD was applied for 1 minute and the plating bath temperature was 50° C. A top soft gold layer (99.9% gold) of 0.4 μm was plated on the nickel using AURONAL™ BGA LF gold electroplating bath. The gold electroplating was done at a current density of 1 ASD for 4 minutes at 50° C. The pH of the gold electroplating bath was 5.5 during plating.

The contact resistance of the substrate was measured over an applied normal force of 0-100 cN as described in Example 1. Contact resistance was measured after plating at room temperature and again after heat treatment for 24 hours at 180° C. in air.

An aqueous bismuth electroplating bath was prepared as shown in the table below.

TABLE 14

| Component | Amount |
|---|---|
| Methane sulfonic acid | 58.6 g/L |
| Bismuth (III) ions from Bismuth methane sulfonate | 5 g/L |
| Water | To desired volume |
| pH | 1-2 |

The bath was heated to 40° C. A platinized titanium anode was immersed into the bath and connected to a DC power supply. A current of 0.2 ASD was applied for 5 sec to deposit bismuth layers on brass copper-zinc alloy substrates 2.5 cm×3.8 cm with nickel barrier layers 0.5 μm thick and gold layers 0.4 μm thick. The current was powered off and the substrates removed, washed with DI water, and dried. Contact resistance was measured promptly, then after heating for 24 hours at 180° C. in air. Appearance of the substrates was evaluated visually and appeared bright and gold in color. No change in contact resistance was observed. The contact resistance remained about 2 mΩ at 100 cN applied force, as disclosed in Table 15 below.

TABLE 15

| Normal Force (cN) | Gold (mΩ) | Gold, Heat Treated (mΩ) | Bismuth Plated Gold (mΩ) | Bismuth Plated Gold, Heat Treated (mΩ) |
|---|---|---|---|---|
| 0 | 20 | 22 | 20 | 20 |
| 10 | 10 | 10 | 10 | 12 |
| 15 | 4.9 | 3.9 | 6.0 | 5.0 |
| 20 | 4.5 | 3.1 | 4.6 | 4.3 |
| 30 | 4 | 2.7 | 3.6 | 4 |
| 40 | 3.5 | 2.5 | 3.3 | 3.8 |
| 50 | 3.3 | 2.4 | 3 | 3.5 |
| 100 | 2.7 | 1.9 | 2.2 | 2.7 |

What is claimed is:

1. A method of electroplating bismuth comprising: providing a substrate comprising silver, silver alloy, gold or gold alloy; providing a bismuth electroplating bath comprising (i) a source of bismuth ions, and (ii) an acid, a salt of an acid or combinations thereof, wherein the bismuth electroplating bath has a pH of less than 7; contacting the substrate with the bismuth electroplating bath; applying a current to the bismuth electroplating bath and substrate; and electroplating bismuth on the silver, silver alloy, gold or gold alloy of the substrate to a thickness of greater than 0 to equal to or less than 20 nm.

2. The method of claim 1, wherein the thickness ranges from greater than 1 nm to 10 nm.

3. The method of claim 2, wherein the thickness ranges from greater than 1 nm to 7 nm.

4. The method of claim 1, wherein a current density for electroplating the bismuth ranges from 0.1 ASD and higher.

5. The method of claim 4, wherein the current density for electroplating the bismuth ranges from 0.1-5 ASD.

6. The method of claim 1, wherein the bismuth electroplating bath has a pH of from 0 to 6.

7. The method of claim 6, wherein the bismuth electroplating bath has a pH of from 0 to 2.

8. The method of claim 1, wherein the acid, the salt of an acid or the combinations thereof comprises an organic acid chosen from alkane sulfonic acids, alkanol sulfonic acids, or aromatic sulfonic acids, a salt of the organic acid, or a combination thereof.

9. The method of claim 8, wherein the acid comprises an organic acid chosen from alkane sulfonic acids.

* * * * *